US005711271A

United States Patent [19]

Schlagmueller et al.

[11] Patent Number: 5,711,271

[45] Date of Patent: Jan. 27, 1998

[54] THROTTLE APPARATUS FOR AN INTERNAL COMBUSTION ENGINE

[75] Inventors: Walter Schlagmueller, Schwieberdingen; Gerhard Schellenberg, Fellbach; Thomas Wiesa, Vaihingen; Rolf Litzinger, Hechingen; Harald Laue, Esslingen; Jurgen Rottler, Karlsruhe; Ralph Schimitzek, Obersulm/Sulzbach; Peter Jauernig, Tiefenbronn, all of Germany

[73] Assignee: Robert Bosch GmbH, Stuttgart, Germany

[21] Appl. No.: 765,253

[22] PCT Filed: Mar. 6, 1995

[86] PCT No.: PCT/DE96/00394

§ 371 Date: Feb. 12, 1997

§ 102(e) Date: Feb. 12, 1997

[87] PCT Pub. No.: WO96/35047

PCT Pub. Date: Nov. 7, 1996

[30] Foreign Application Priority Data

May 5, 1995 [DE] Germany ..... 195 16 584.5

[51] Int. Cl.[6] ..... F02M 3/00

[52] U.S. Cl. ..... 123/339.24

[58] Field of Search ..... 123/334.24, 339.25, 123/337

[56] References Cited

U.S. PATENT DOCUMENTS

| | | | |
|---|---|---|---|
| 4,409,940 | 10/1983 | Gaus | 123/337 |
| 4,572,128 | 2/1986 | Okamoto et al. | 123/339.24 |
| 4,672,935 | 6/1987 | Abe | 123/339.24 |
| 4,672,936 | 6/1987 | Abe | 123/339.24 |
| 4,698,535 | 10/1987 | Shiraki et al. | 123/337 |
| 4,829,960 | 5/1989 | Yuzawa et al. | 123/339.24 |
| 5,007,396 | 4/1991 | Wellenkotter et al. | 123/339.24 |
| 5,094,213 | 3/1992 | Dudek et al. | 123/339.27 |
| 5,467,749 | 11/1995 | Meiwes et al. | 123/339.27 |

*Primary Examiner*—Raymond A. Nelli

*Attorney, Agent, or Firm*—Edwin E. Greigg; Ronald E. Greigg

[57] ABSTRACT

Electronic engine control systems have a plurality of individual components on the intake tube, some of them located relatively far from one another. For electrically connecting the individual components to the electronic control unit, relatively long electric connecting lines and a relatively large number of plug connections are therefore necessary. This invention sets forth a preassembled throttle apparatus which includes at least one throttle device, rotatably accommodated in a throttle valve support, and an idling adjuster in a housing; the throttle apparatus has a bypass conduit, which bypasses the throttle device and which can be varied by the idling adjuster, into which a regeneration valve can output fuel, the regeneration valve being triggerable by an electronic control unit that is also accommodated in the housing. The throttle apparatus of the invention is intended particularly for mixture-compressing internal combustion engines with externally supplied ignition.

11 Claims, 5 Drawing Sheets

THROTTLE APPARATUS FOR AN INTERNAL COMBUSTION ENGINE

PRIOR ART

The invention is based on a throttle apparatus for an internal combustion engine. A throttle apparatus is already known (MTZ, Motortechnische Zeitschrift 54 (1993), No. 11, p. 601), which is embodied as a preassembled unit. The throttle apparatus has a throttle device in the form of a throttle valve, which is rotatably accommodated in a throttle valve support. The throttle apparatus also has a bypass conduit, whose cross section is variable by an idling adjuster for the sake of idling regulation. Upstream of the throttle valve, a temperature sensor is also provided, which measures the temperature of the air flowing in the throttle valve support. The throttle apparatus is mounted on an air distributor, which is provided in the region of a cylinder head of the engine, in order to distribute the air, metered by the throttle valve, via individual intake tubes to individual combustion chambers of the engine. A pressure sensor, which measures the air pressure in the air distributor, is accommodated in the air distributor.

Modern engine control systems require a great deal of information about important operating variables of the engine; the information is furnished by sensors and delivered in the form of electrical signals to an electronic control unit for evaluation. From the sensor signals, the electronic control unit calculates corresponding trigger signals for the final control elements of the engine controller, such as for ignition or for mixture preparation. One important variable is the air mass aspirated by the engine. It is known to ascertain the air mass for instance from the rotary position of the throttle valve and the associated engine rpm. However, that method is relatively inaccurate, and hence air flow rate meters are used, which determine the air mass or flow rate in the throttle valve support upstream of the throttle valve by means of a heated, temperature-dependent measuring element in the form of a hot wire or hot film. Such air flow rate meters are relatively expensive, however.

A further possibility for determining the air mass aspirated by the engine with relatively high accuracy is to ascertain the air mass indirectly from the density of the air in the throttle valve support and from the associated displacement volume of the individual pistons of the engine. The density of the aspirated air can be calculated from the status variables of temperature and pressure of the air; to that end, in the prior art referred to at the outset, a temperature sensor and a pressure sensor are provided. However, in the engine idling range, a relatively low flow speed prevails in the throttle valve support, and thus the aspirated air stays for a relatively long time in the throttle valve support and in the air distributor that for instance is appended to it. The air can then heat up on the warm walls of the throttle valve support and the air distributor, which raises the temperature of the air and changes the air mass, yet the temperature sensor and pressure sensor detect this only with some delay, so that particularly in the critical idling phase of the engine, measurement inaccuracies can occur.

Besides detecting the air mass aspirated by the engine, an engine control system also takes on the task of controlling a regeneration valve, which is part of a fuel vapor trapping system in a fuel tank of the engine. In this kind of fuel vapor trapping system, the fuel vapors in the tank are first temporarily stored in an adsorption filter and then, at certain operating states of the engine, are fed by means of the regeneration valve into the throttle valve support. For that purpose, the engine control system requires among other things information about the current rotary position of the throttle valve, and a rotational angle encoder, for instance in the form of a precision potentiometer, is therefore provided on a shaft of the throttle valve.

The electronic control unit, the regeneration valve, the idling adjuster, the temperature sensor, and the pressure sensor have until now been accommodated in individual housings, relatively far away from one another. The electronic control unit is typically located in the engine compartment or in the passenger compartment of a motor vehicle. The idling adjuster, the regeneration valve, the temperature sensor and the pressure sensor are provided in the region of the throttle valve support, and thus for connection to the electronic control unit, in particular, many electrical connecting lines and plug connections are necessary. Especially in mass-produced assembly, however, it is expensive to install the individual components and connecting lines and test them.

ADVANTAGES OF THE INVENTION

The throttle apparatus of the invention for an internal combustion engine, has the advantage over the prior art that a compact component is created which can be manufactured economically and which, in particular as a prefabricated, pretested component unit, can be installed in the motor vehicle in a simple way. The omission of the otherwise usual individual housings, along with their electrical connecting lines and plug connections advantageously produces still further cost savings as well as simplified assembly in mass production. Moreover, because of the reduced number of electrical connecting lines and plug connections, the operational safety and reliability of the throttle apparatus are higher. Accommodating a regeneration valve in a bypass conduit that bypasses the throttle valve makes an especially compact embodiment of the throttle apparatus of the invention possible.

Advantageous further features of and improvements to the throttle apparatus are possible by means of the provisions recited hereinafter.

The additional disposition of a temperature sensor and for instance a pressure sensor in the bypass conduit has the advantage that particularly during the critical idling phase of the engine, a precise determination of the air mass flowing in the throttle valve support is possible.

BRIEF DESCRIPTION OF THE DRAWING

An exemplary embodiment of the invention is shown in simplified form in the drawing and described in further detail in the ensuing description.

DESCRIPTION OF THE EXEMPLARY EMBODIMENT

Figure 1:
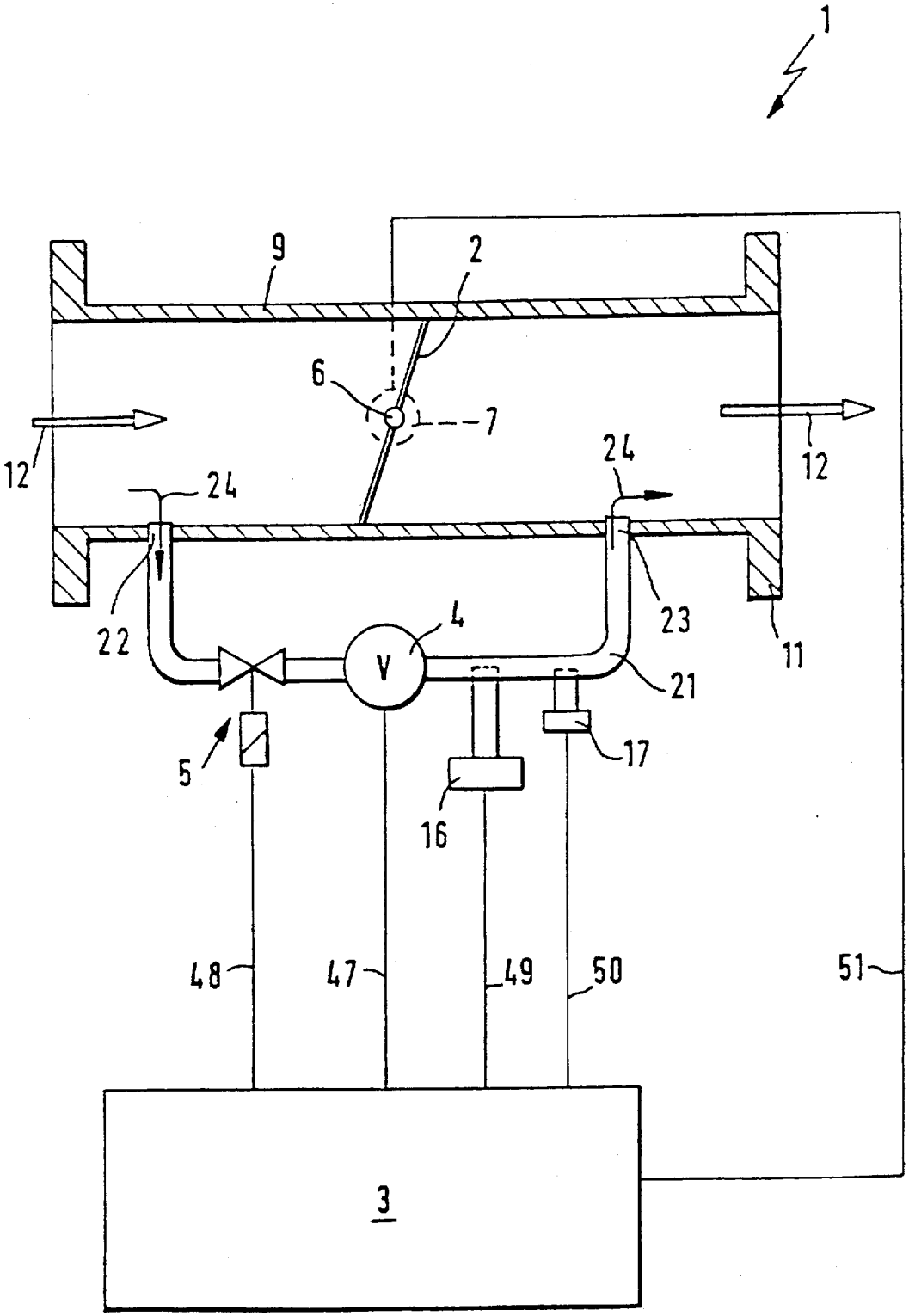
FIG. 1 is a schematically simplified functional illustration of a throttle apparatus according to the invention.

In FIGS. 1–5, a throttle apparatus 1 is shown, which as a functional unit is part of an engine control system of an internal combustion engine not shown in further detail. The throttle apparatus 1 essentially includes a throttle device 2, an electronic control unit 3, a regeneration valve 4, and an idling adjuster 5, and it is intended in particular for mixture-compressing internal combustion engines with externally supplied ignition.

The regeneration valve 4 is part of a fuel vapor trapping system, not shown in further detail, of a fuel tank of the engine, whose layout and function can be learned for instance from Bosch Technische Unterrichtung, Motormanagement Motronic, 2nd Edition, August 1993, pp. 48 and 49. The disclosure of the above publication is hereby expressly incorporated by reference in the present application.

The throttle apparatus 1 has a housing, which is made, for instance of plastic, by plastic injection molding. As shown in FIG. 2, the throttle apparatus 1 or the housing has a tubular, elongated shape, formed essentially by a throttle valve support 9. On an end region toward the engine, the throttle valve support 9 has a flange part 11, which serves to secure an air distributor, for instance, not shown in further detail. The throttle device 2 is rotatably accommodated in the throttle valve support 9 and takes the form for instance of a throttle valve 2 shown in dashed lines in FIG. 2. Flowing in the interior of the throttle valve support 9 is a gaseous medium, in particular the air aspirated by the engine, which flows into the throttle valve support 9 for instance via an air filter, not shown in detail. The air in the throttle valve support 9 flows from left to right in terms of FIG. 1 and from top to bottom in terms of FIGS. 2 and 3. The flow direction of the air is indicated by corresponding arrows 12 in FIGS. 1, 2 and 3.

The engine performance is controlled in a known manner by rotating the throttle valve 2 in the throttle valve support 9, causing more or less air to flow past the throttle valve 2. The throttled air flows from the throttle valve support 9 for instance into the air distributor, which distributes the air via individual intake tubes to the individual combustion chambers of the engine. A fuel injection valve provided in the intake tube upstream of an inlet valve of the engine mixes fuel with the air, so that an ignitable, fuel-air mixture can be obtained in the combustion chamber. For rotating the throttle valve 2, an actuation device, not shown in detail, is for instance provided, which takes the form of a cable pulley, for instance. The cable pulley is mounted, in a manner fixed against relative rotation, on a throttle valve shaft 6 of the throttle valve 2, so that it can be rotated by means of a cable that leads to an accelerator pedal.

Figure 2:
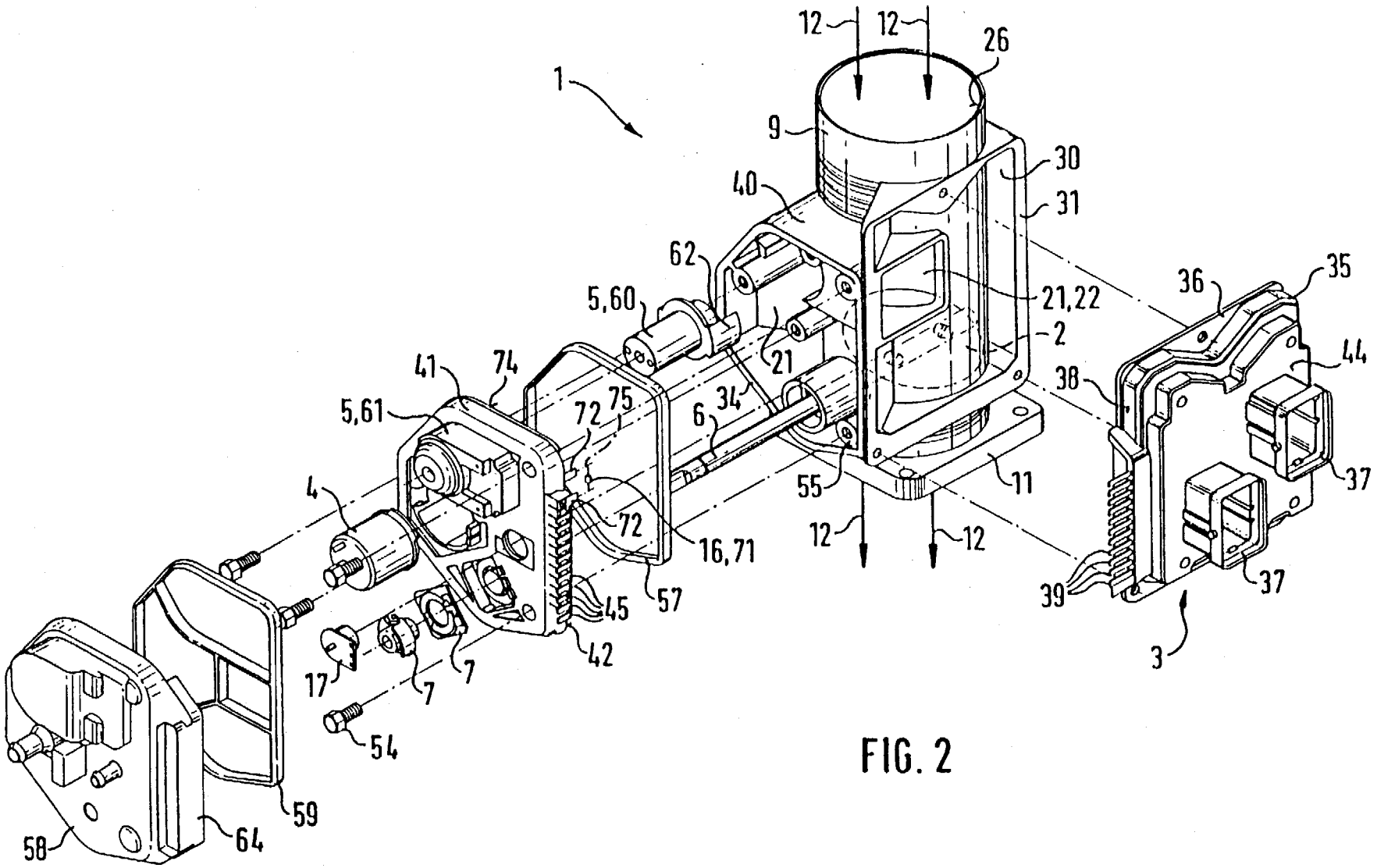
FIG. 2 is an exploded view of the throttle apparatus of the invention.

As shown in FIG. 1, the throttle apparatus 1 has a bypass conduit 21, which connects a withdrawal opening 22, located in the throttle valve support 9 upstream of the throttle valve 2, with a discharge opening 23 located downstream of the throttle valve 2, so that some of the air flowing in the throttle valve support 9 flows through the bypass conduit 21 to bypass the throttle valve 2. The flow direction of the air flowing in the bypass conduit 21 is represented by corresponding arrows 24 in FIGS. 1, 4 and 5.

The electronic control unit 3 of the engine control system requires many items of information about important engine operating variables, which are furnished by sensors and delivered to the electronic control unit 3 for evaluation. One important operating variable is the mass, or flow rate, of air aspirated by the engine. As is known, the air mass can be calculated from the density and the volume of the air. The volume of the air is dictated by the displacement volume of the individual pistons of the engine. The density of the air can be calculated from the status variables, the temperature and the pressure of the air, for instance with the aid of the general gas equation for ideal gases. With the displacement volume of the individual pistons of the engine and the density of the air, all the variables of the electronic unit 3 for calculating the mass of air flowing in the throttle valve support 9 are now available. Ascertaining the density of the air is done by means of a temperature sensor 16 and a pressure sensor 17. As shown in FIG. 1, the temperature sensor 16 is disposed in the bypass conduit 21, in order to measure the temperature of the air flowing in the bypass conduit 21. The pressure sensor 17 for pressure measurement can also be disposed in the bypass conduit 21, in order to measure the pressure there of the flowing air. However, it is also possible for it to be disposed at some arbitrary point, such as on the throttle valve support 9, in order to measure the pressure of the flowing air there.

Measuring the temperature in the bypass conduit 21 by means of the temperature sensor 16 has the advantage that particularly at low air throughputs in the throttle valve 9, improved measurement accuracy occurs compared with temperature measurement in the throttle valve support 9. This is due on the one hand to the fact that pulsations in the flow caused by the opening and closing of the inlet valves can advance as far as the measurement location of the temperature sensor 16 in the bypass conduit 21, where they could impair the outcome of measurement, only in attenuated form. On the other hand, in the engine idling range, because of the throttling action of the throttle valve 2, a pressure difference prevails at the throttle valve 2, which leads to an increase in the air flow rate in the bypass conduit 21. Because of the increased air flow rate in the bypass conduit 21 in the idling range, temperature changes in the aspirated air, for instance from warming of the throttle valve support 9, can be detected quickly, so that particularly during the critical idling phase of the engine, high measurement accuracy ensues.

Figure 3:
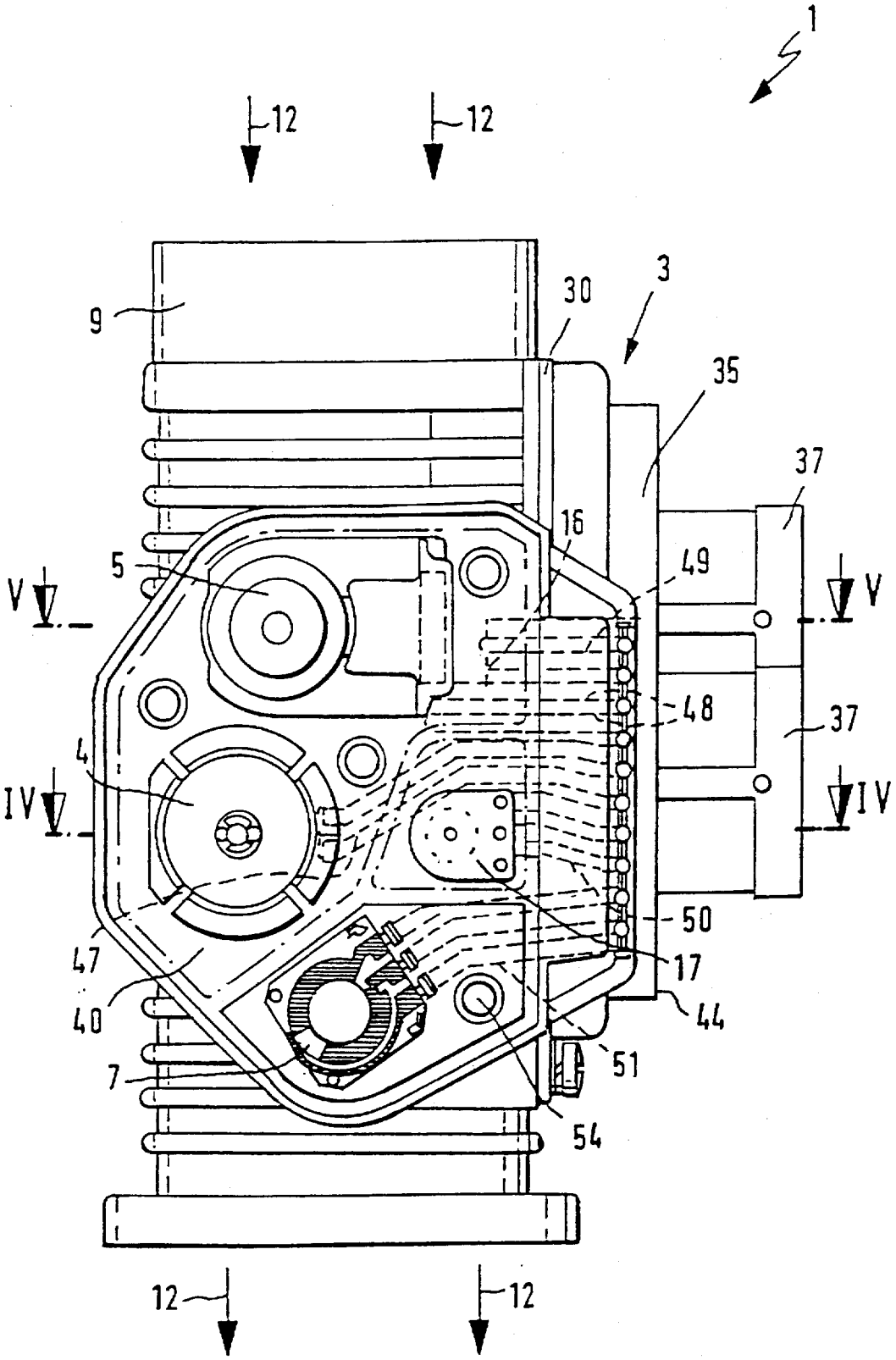
FIG. 3 is a side view of the throttle apparatus of the invention.

As shown in FIG. 2 in an exploded view and in FIG. 3 in a side view of the throttle apparatus 1, the electronic control unit 3 is accommodated in a first, boxlike housing part 30 of the throttle apparatus 1. The first housing part 30 is open leading radially away from the throttle valve support 9 and has a first housing edge 31. The primary component of the electronic control unit 3 is a substrate 32, shown in FIG. 4 in a sectional view taken along a line IV—IV of FIG. 3, on which many electrical components are mounted, for instance in hybrid form. The substrate 32 is embedded in plastic, for instance, resulting in a sealed, compact control unit module 35. The control unit module 35 also has a metal plate 36, likewise embedded in the plastic, which has a plurality of openings, so that the metal plate 36 or the control unit module 35 can for instance be screwed by means of screws, not shown, to the first, boxlike housing part 30. The control unit module 35 is then seated on the first housing edge 31 and closes off the first housing part 30. In the installed state, the metal plate 36 is oriented toward a circular inner wall 26 of the throttle valve support 9 and close to it, so that via the metal plate 36 good thermal contact with the air flowing in the throttle valve support 9 can be established, so that the heat arising in operation of the electronic control 3 can be dissipated by the air flowing in the throttle valve support 9. As shown in further detail in FIG. 2, the electronic control unit 3, for purposes of contacting and power supply, has connector strips 37, for instance two in number, which protrude from an outer face 44 of the control unit module 35, and onto which plugs can be plugged. The control unit module 35 also has contact lugs 39, protruding from a side face 38, which are at least partly embedded in the plastic of the control unit module 35. The contact lugs 39 are electrically connected, via electrical connections not shown in detail, to the electrical components of the substrate 32.

As shown in FIG. 3, crosswise to the first boxlike housing part 30, a second boxlike housing part 40 is provided, thus forming a rectangular corner, for instance. The second boxlike housing part 40 at least partly forms the bypass conduit 21. The second housing part 40 is likewise open leading radially away from the throttle valve support 9 and has a second housing edge 34. The bypass conduit 21 is closed off from the outside by an aggregate module 41 that covers the second boxlike housing part 40. The aggregate module 41 is platelike in shape and is made from plastic, for instance. The aggregate modulate 41 has a plurality of recesses for receiving and holding the regeneration valve 4, the idling adjuster 5 and the pressure sensor 17, for instance by means of snap connections. The aggregate module 41 is also used for retaining a rotational angle encoder 7, which is embodied for instance in the form of a precision potentiometer. The rotational angle encoder 7 is joined in a manner fixed against relative rotation to the shaft 6, extending in the second housing part 40, of the throttle valve 2 so as to assume a certain electrical resistance as a function of the rotary position of the throttle valve 2, so that corresponding electrical signals can be delivered to the electronic control unit 3. The layout of rotational angle encoders 7 is known to one skilled in the art and may be learned for instance from Published, Non-Examined German Patent Application DE-OS 42 11 616 U.S. Pat. No. 5,365,168.

The aggregate module 41 also has electric lines 47, 48, 49, 50, 51, for instance embedded in the plastic of the aggregate module 41, in order to establish an electrical connection of the components 4, 5, 7, 16, 17 of the aggregate module 41 with the electronic control unit 3. As shown in FIG. 3, the regeneration valve 4 is connected via the electric lines 47, the idling adjuster 5 via the electric lines 48, the temperature sensor 16 via the electric lines 49, the pressure sensor 17 via the electric lines 50, and the rotational angle encoder 7 via the electric lines 51 to the aggregate module 41 by contact lugs 45. The contact lugs 45 protrude from a side face 41 of the aggregate module 41 and have an angled form. In the installed state of the aggregate module 41, an end region of the contact lugs 45 of the aggregate module 41 extends parallel to and touching the contact lugs 39 of the control unit module 5, so as to establish an electrical contact, for instance by means of laser soldering.

For installing the aggregate module 41, a plurality of screws 54 are for instance provided, which can be screwed into threaded receptacles 55 provided in the second boxlike housing part 40. A first sealing frame part 57, provided between the aggregate module 41 and the second housing edge 34 of the second housing part 40 in the process seals off the aggregate module 41 from the second boxlike housing part 40. A closure cap 58 that can be mounted on the aggregate module 41 and a second sealing frame part 59 provided between the closure cap 58 and the aggregate module 41 seals off the aggregate module 41 from the outside, so that no water, dirt or the like can damage the components 4, 5, 7, 16, 17 on the aggregate module 41. The closure cap 58 also has a cufflike feature 64, which in the installed state of the closure cap 58 likewise surrounds and seals off the contact lugs 39 of the control unit module 35 which are coupled with the contact lugs 45. The closure cap 58 is retained on the second housing part 40, for instance by means of a snap connection or the like.

The regeneration valve 4 is triggered in clocked fashion, in a known manner, by the electronic control unit 3 in order in certain operating states, especially engine idling, to introduce fuel vapor into the bypass conduit 21 downstream of the throttle valve 2, the fuel vapor thereafter flowing on from the bypass conduit 21 into the throttle valve support 9. The regeneration valve 4 is embodied so as to be actuatable electromagnetically, and it has a layout that can be learned for instance from Published, Non-Examined German Patent Application DE-OS 40 23 044 and is therefore not described in detail hereinafter.

Figure 5:
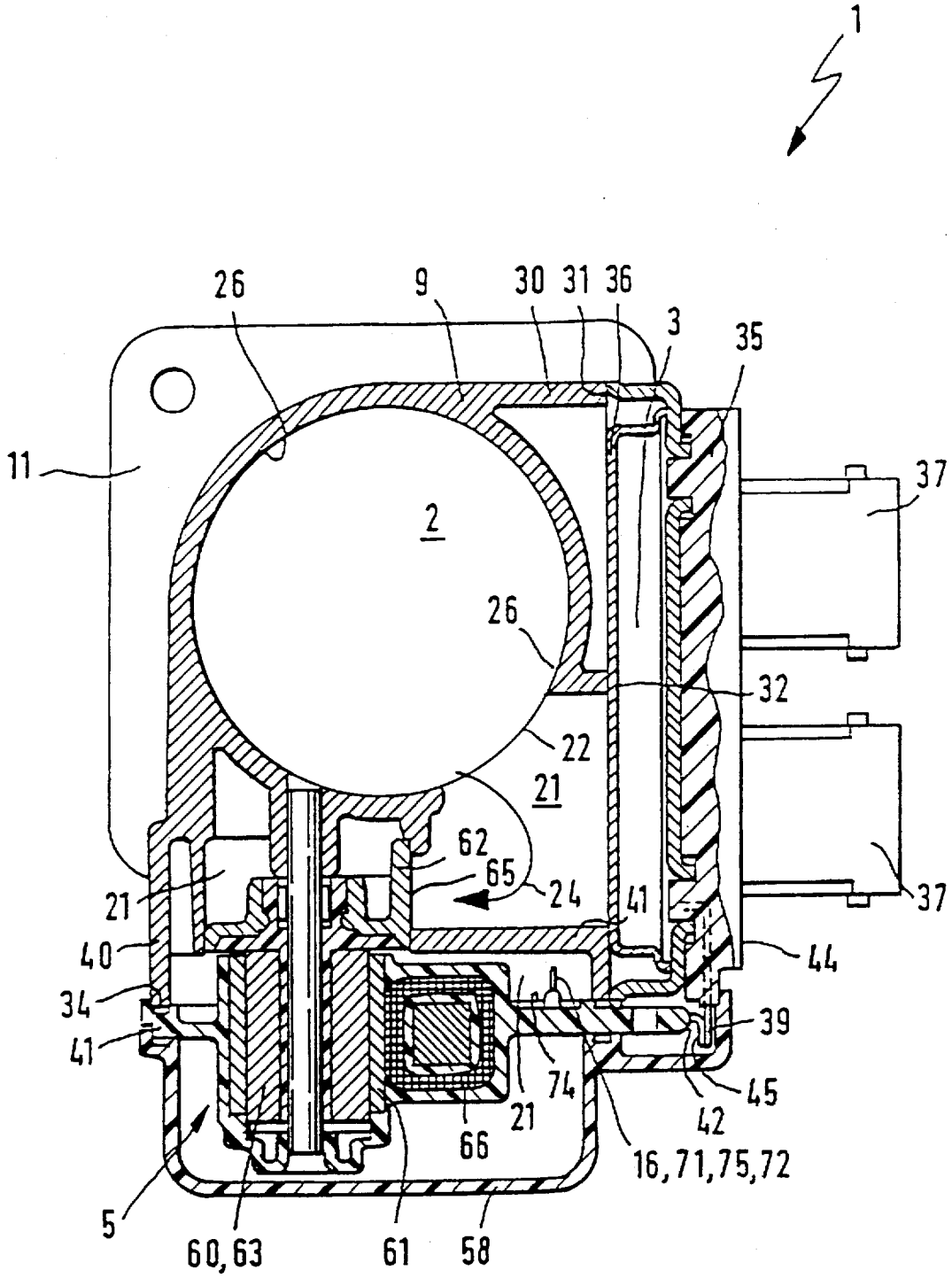
FIG. 5 is a sectional view of the throttle apparatus of the invention along a line V—V of FIG. 3.

The idling adjuster 5 likewise embodied as electromagnetically actuatable, for instance in the form of an electrical rotary adjuster, and is triggerable by the electronic control unit 3. The idling adjuster 5 is formed essentially by a rotor 50 and a stator 61. As FIG. 5 shows in detail, a permanent magnet 63, for instance, is fixedly connected to the rotor 60 and with the rotor 60 is supported rotatably on a fixed axis in the stator 61. The end region of the rotor 60 takes the form for instance of a slide 62 in the form of a tubular segment, so that by the rotary slide principle, by varying the angular position of the slide 62, it can increase or decrease an opening cross section 65 of the bypass conduit 21, by means of which the air throughput in the bypass conduit 21 can be adjusted. The stator 61 substantially comprises a coil 61, which when current is supplied to it generates a magnetic field, upon whose action on the permanent magnet 63 the rotor 60 having the slide 62 can be rotated. The supply of current is accomplished by the electronic control unit 3, for instance with the aid of the electrical signals of the rotational angle encoder 7, so as to keep a demanded idling rpm of the engine constant virtually independently of the load on the engine. The layout of idling adjusters is known to one skilled in the art and may be learned for instance from German Published, Non-Examined Patent Application DE-OS 42 26 548.

Figure 4:
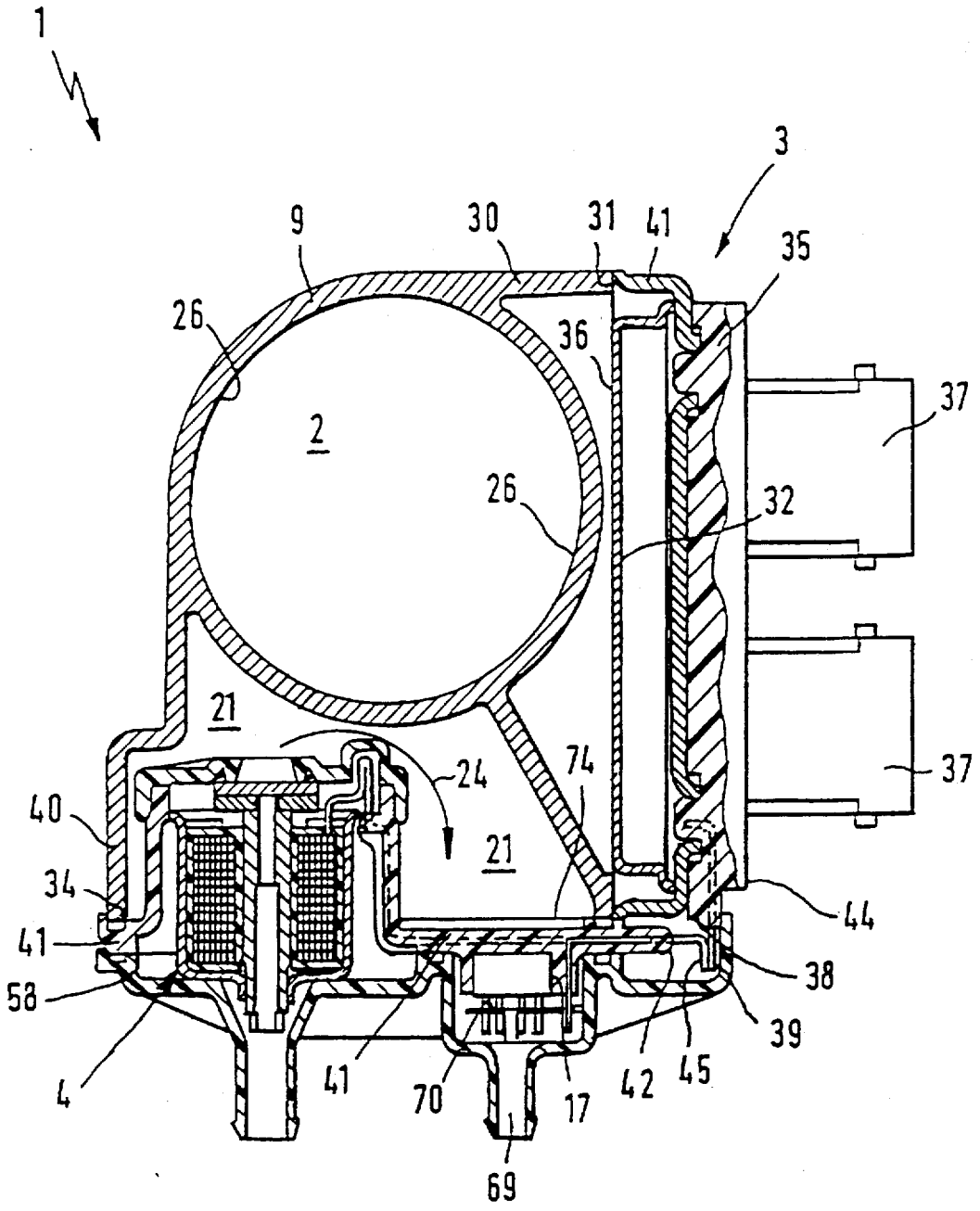
FIG. 4 is a sectional view of the throttle apparatus of the invention along a line IV—IV of FIG. 3.

The accommodation of the components 4, 5, 7, 16 and 17 of the aggregate module 41 in the second boxlike housing part 40 and the embodiment of the bypass conduit 21 are accomplished such that in the flow direction 24 of the air flowing in the bypass conduit 21, the idling adjuster 5 comes first, then the regeneration valve 4, then the temperature sensor 16, and finally the pressure sensor 17. The intended sequence in the flow direction 24 in the bypass conduit 21 of the idling adjuster 5, regeneration valve 4, temperature sensor 16 and pressure sensor 17, can be transposed, however. For instance, it is thus also possible to provide the regeneration valve 4 downstream of the temperature sensor 16 and of the idling adjuster 5. The pressure sensor 17 may also be accommodated at an arbitrary point in the bypass conduit 21 or on the throttle valve support 9 itself. As shown in FIG. 4, which is a sectional view along a line IV—IV in FIG. 3, the pressure sensor 17 may for instance also be accommodated on the same level as the regeneration valve 4 and downstream of it in the bypass conduit 21.

The pressure sensor 17 shown in section in the exemplary embodiment of FIG. 4 does not measure the pressure in the bypass conduit 21 directly but instead has a hose connection 69, for instance, so that via a hose connection it can measure the pressure of the air, flowing in the throttle valve support 9, downstream of the throttle valve 2. To that end, the pressure sensor 17 has a diaphragm 70, for instance, which deforms to a variable extent if there is a pressure difference. The deformation of the diaphragm 70 can be detected by means of strain gauge resistors, applied for instance by thick film technology to the diaphragm 70, which furnish electrical signals corresponding to the deformation that are then evaluated by the electronic control unit 3 in order to determine the pressure. However, pressure sensors of a different design may also be used. The layout of pressure sensors is familiar to one skilled in the art and may be found for instance in German Published, Non-Examined Patent Application DE-OS 41 11 149.

As the temperature sensor 16, a temperature-dependent resistor is provided, embodied for instance as an NTC or PTC resistor 71. As shown in FIG. 2, the resistor 71 has a cylindrical shape, for instance. However, it is also possible to use a temperature-dependent resistor in the form of a wire, film or foil. The resistor 71 shown in FIG. 2 is mounted on an end face 74 of the aggregate module 41 oriented toward the throttle valve support 9, spaced apart from it and is retained for instance by means of retainers 72 protruding from the end face 74, which is accomplished for instance by soldering its connection wires 75 to the retainers 72. However, it is also possible to use temperature sensors of some other embodiment. For instance, temperature sensors that can be introduced in plug-in fashion into the aggregate module 41 can also be used, which measure the temperature of the air flowing in the bypass conduit by means of a temperature-dependent sensor part that protrudes partway into the bypass conduit 21. Such temperature sensors are known to one skilled in the art, for instance from German Published, Non-Examined Patent Application DE-OS 30 44 419.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A throttle apparatus for air flow of an internal combustion engine, having a housing, at least one throttle device rotatably supported in a throttle valve support of the housing, a bypass conduit that bypasses some air flow through the throttle device, the cross section of said bypass conduit is variable by an idling adjuster (5), the throttle device (2) and the idling adjuster (5) are accommodated in the housing (9, 30, 40), and an electronic control unit (3) and a regeneration valve (4) are also disposed in the housing (9, 30, 40).

2. The throttle apparatus of claim 1, in which a temperature sensor (16) is disposed in the bypass conduit (21), for temperature measurement of the air flow in the bypass conduit (21).

3. The throttle apparatus of claim 1, in which a pressure sensor (17) is disposed in the bypass conduit (21), for pressure measurement of the air flow in the bypass conduit (21).

4. The throttle apparatus of claim 1, in which a rotational angle encoder (7) is provided to ascertain an angular position of the throttle device (2).

5. The throttle apparatus of claim 1, in which the regeneration valve (4) is disposed on the bypass conduit (21) in such a way that the regenerative valve introduces fuel into the bypass conduit (21) downstream of the idling adjuster (5).

6. The throttle apparatus of claim 2, in which the temperature sensor (16) is disposed downstream of the idling adjuster (5) in the bypass conduit (21).

7. The throttle apparatus of claim 6, in which the temperature sensor (16) is disposed downstream of the regeneration valve (4) in the bypass conduit (21).

8. The throttle apparatus of claim 1, in which the electronic control unit (3) is accommodated in a first, boxlike part (30) of the housing (9).

9. The throttle apparatus of claim 1, in which the throttle apparatus (1) has a second, boxlike housing part (40), which at least partially forms the bypass conduit (21) of the throttle apparatus (1).

10. The throttle apparatus of claim 8, in which the electronic control unit (3) has contact strips (39), which together with corresponding contact strips (45) of an aggregate module (41) accommodated in the second, boxlike housing part (40) establish an electrical connection.

11. The throttle apparatus of claim 9, in which the electronic control unit (3) has contact strips (39), which together with corresponding contact strips (45) of an aggregate module (41) accommodated in the second, boxlike housing part (40) establish an electrical connection.

* * * * *